United States Patent [19]

Malafouris

[11] 4,228,784

[45] Oct. 21, 1980

[54] FIREPLACE FORCED AIR HEATING APPARATUS

[76] Inventor: Dannie O. Malafouris, P.O. Box 13637, Portland, Oreg. 97303

[21] Appl. No.: 945,135

[22] Filed: Sep. 22, 1978

[51] Int. Cl.[3] ..... F24B 7/00

[52] U.S. Cl. ..... 126/121; 126/129; 126/131; 237/51

[58] Field of Search ..... 126/121, 128, 129, 130, 126/131, 135, 152 B, 163 R, 164 A; 237/51

[56] References Cited

U.S. PATENT DOCUMENTS

| | | | |
|---|---|---|---|
| 3,452,737 | 7/1969 | Pellegrino et al. | 126/121 |
| 3,866,595 | 2/1975 | Jones | 126/121 |
| 4,010,729 | 3/1977 | Egli | 126/164 X |
| 4,018,208 | 4/1977 | Hamilton | 237/51 X |
| 4,074,681 | 2/1978 | Whiteley | 126/121 |
| 4,170,218 | 10/1979 | Hartley | 126/121 |

*Primary Examiner*—James C. Yeung
*Assistant Examiner*—Larry Jones
*Attorney, Agent, or Firm*—Eugene D. Farley

[57] ABSTRACT

Fireplace forced air heating apparatus comprises a heat exchanger having a pair of tubes, which may serve as andirons, communicating with a plenum within the heat exchanger and extending outwardly to the front of the fireplace. The tubes connect with duct work including a reversible fan, a hot air register, and a baffle all designed for interchangeable connection to the tubes as required to adapt the installation to various fireplace settings. The tubes and duct work are telescoping to accommodate fireplaces of varying dimension.

5 Claims, 5 Drawing Figures

FIREPLACE FORCED AIR HEATING APPARATUS

BACKGROUND AND SUMMARY OF THE INVENTION

This invention pertains to fireplace forced air heating apparatus of the class including a heat exchanger adapted for placement within the fireplace, and associated duct work and fan for driving cold air through the heat exchanger and the resulting hot air out into the space to be heated.

The fireplace forced air heating apparatus disclosed herein is an improvement on that disclosed in Jones U.S. Pat. No. 3,866,595.

It has for its general purposes the provision of such apparatus which is reversible from left to right and which is dimensionally adjustable as required to suit fireplace installations of various character and size.

It has for its further purpose the provision of such apparatus wherein the associated duct work serves also as andiron supports for the fuel being burned in the fireplace, thereby eliminating the necessity of providing a separate grate or andirons.

Further purposes of the present invention are the provision of such apparatus which is durable, simple in constuction, and easily and quickly installed in any of the conventional fireplaces, including those equipped with glass screens, without modification of the fireplace or screen structure.

Generally stated, these and other objects of the invention are achieved by the provision of apparatus comprising a heat exchanger contoured and dimensioned for placement adjacent the rear wall of a fireplace and enclosing a plenum. A pair of open-ended tubes are connected to the lower portion of the heat exchanger, communicating with the plenum and extending outwardly. A segmented, double T'd, open-ended duct is placed across the front of the fireplace with the Ts connected to and communicating with the respective open ends of the tubes.

A pair of longitudinally spaced ports are located in the duct substantially opposite the T segments thereof. A hot air register and a baffle are interchangeably connectable to the respective ports.

A closure and fan assembly are interchangeably connectable to the open ends of the duct.

The fan assembly accordingly may be placed on either side of the fireplace depending upon dimensional requirements and the heating requirments of the room. The baffle, register and plug then may be connected as required to establish the desired flow of air through the apparatus.

DESCRIPTION OF A PREFERRED EMBODIMENT OF THE INVENTION

The invention is described herein with particular reference to the accompanying drawings wherein.

Figures 1, 2, 3, 4, 5:
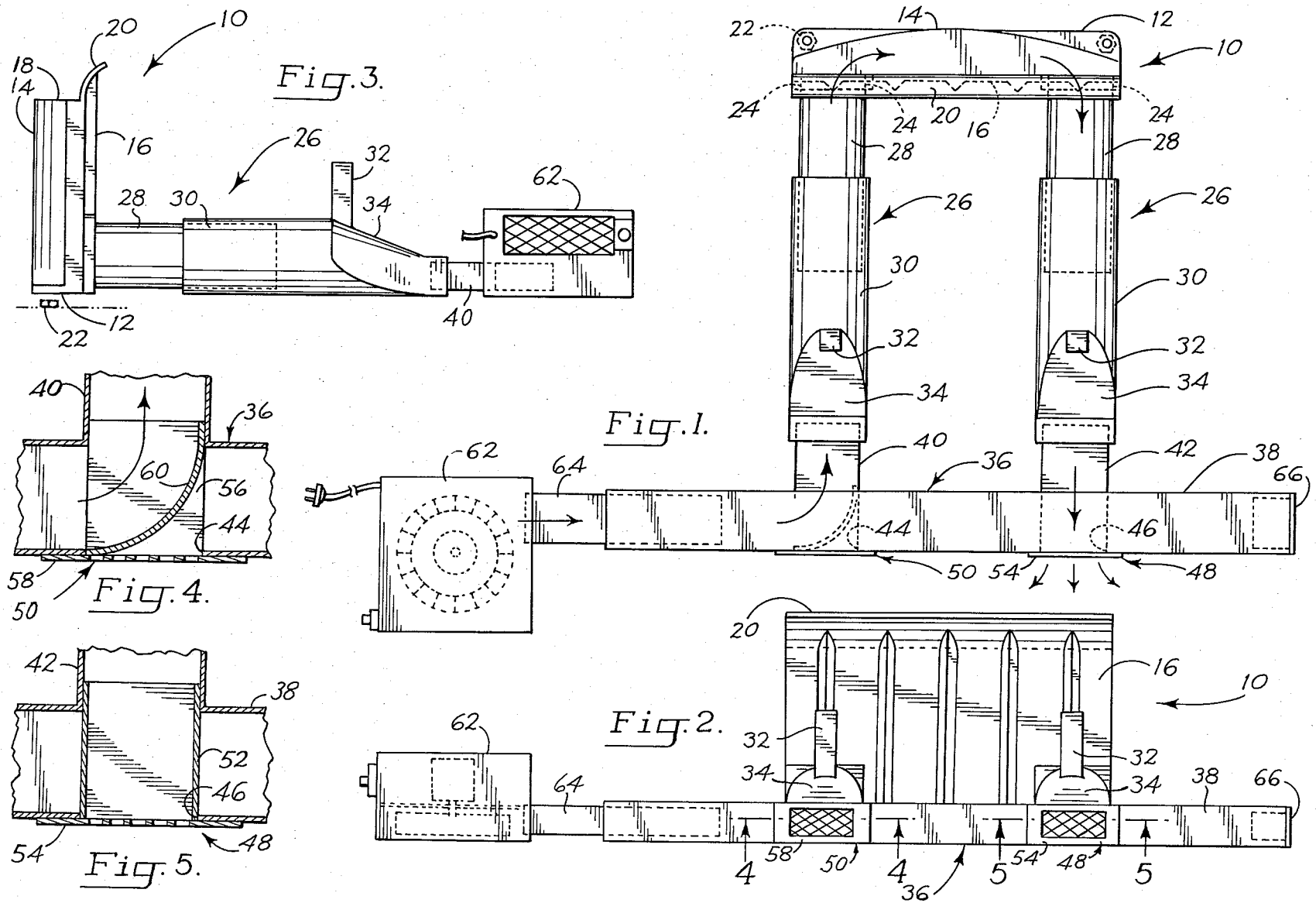
FIG. 1 is a plan view of the apparatus.
FIG. 2 is a view in front elevation of the apparatus.
FIG. 3 is a view in side elevation of the apparatus.

FIGS. 4 and 5 are sectional views taken along line 4—4 and line 5—5 of FIG. 2, respectively.

The hereindescribed fireplace forced air heating apparatus essentially comprises a heat exchanger with associated fan and duct work for drawing cold air from a room, circulating it through the heat exchanger, and discharging the resulting hot air from the apparatus. It is designed to be placed in existing fireplaces of varying contour, dimensions and design without modification thereof.

In the drawings, the heat exchanger unit is indicated generally at 10. It preferably comprises a heavy cast iron unit including a base 12, an outwardly dished back wall 14, a vertically ribbed front wall 16 and a top 18 having a reflector segment 20.

Adjustment screws 22, FIG. 3, are mounted on base 12 for leveling the apparatus within the fireplace. Front wall 16 is provided at its lower portion with a pair of horizontally spaced threaded openings 24.

the structural elements thus described include an interior hollow space or plenum into which cold air is fed and from which hot air is exhausted.

To this end there are provided a pair of horizontally spaced, open ended tubes indicated generally at 26. These preferably are substantial members made of cast iron. They serve the dual functions of conveying the air within the apparatus and of supporting logs, or other fuel, in the manner of andirons. They further serve a heat exchange function since they are located in the fire zone and are made of heat conductive material.

Each of tubes 26 is made of two telescoping segments in order to accommodate the assembly to fireplaces of varying depth. The inner segment 28 has a threaded inner end which screws into threaded opening 24. The outer segment 30 telescopes over the inner segment in a snug sliding fit. It is provided with a log stop 32 which cooperates with the ribbed front wall 16 of the heat exchanger in positioning the logs or other fuel.

Tubes 26 preferably are round in cross section. At its outer end, segment 30 of each tube 26 is flattened at 34 to provide a rectangular opening which will accommodate the associated duct work, which is rectangular in cross section.

The associated duct work comprises principally a segmented, double T'd, open-ended duct indicated generally at 36. As noted, this duct is rectangular in cross section and includes a principal member 38 in which are incorporated two horizontally spaced Ts 40 and 42. This construction is defined herein as a "double T'd duct".

T segments 40 and 42 are spaced horizontally substantially the same as tubes 26. Located substantially opposite the T segments are a pair of ports 44, 46. These make possible reverse installations, i.e. left hand and right hand installation of the associated fan unit.

To this end there are provided a hot air register indicated generally at 48 and a baffle indicated generally at 50.

Hot air register 48, FIG. 5, consists of plug 52 which slips into opening 46 in a snug sliding fit. It also includes a face plate 54 which lies across the port and includes a grill permitting the escape of hot air.

Baffle 50 is constructed in an analogous manner and is readily interchangeable with register 48 in ports 44, 46. It consists of a plug 56, FIG. 4, which is insertable into one of ports 44, 46 and associated face plate 58. This face plate, like face plate 54 of register 48 is provided with a grill. However, in this case the grill is decorative only to give a balanced external appearance, as appears in FIG. 2.

Baffle 50 also includes an internal baffle plate 60 which is arcuate or angular in contour and placement and serves to direct the air flow from duct 36 into duct T segment 40 or 42, as the case may be.

Also provided is a reversible, variable speed electric fan 62 with associated duct 64 which telescopes into one of the open ends of duct 36. This makes the apparatus lengthwise adjustable to suit various space requirements.

A plug 66 fits into either open end of duct 36 and is readily interchangeable with the fan.

OPERATION

The manner of installation and operation of the presently described fireplace forced air heating apparatus is as follows:

Tube segments 28 are threaded into the lower portion of the front face of heat exchanger 10. The resulting assembly then is placed inside the fireplace with the heat exchanger closely adjacent the fireplace back wall.

Tube segments 30 are telescoped over tube segments 28 to extend the tubes to the front portion of the fireplace. Adjustment bolts 22 are adjusted as required to level the assembly.

Segmented duct 36 is coupled to the tubes through T segments 40, 42. Fan 62 is placed on either the right or the left, depending upon the room requirements. Its associated duct 64 is telescoped into one of the other of the open ends of the duct 36. Plug 66 then is placed in the other of the open ends of the duct.

Baffle 50 is inserted in the selected one of ports 44, 46, i.e. that adjacent fan 62. Register 48 is inserted in the other of the ports. If the fireplace is provided with a glass screen, it is installed above the heating apparatus with its lower edge resting on the flat upper surface of duct 36.

In use, fan 62 withdraws cold air from the lower portion of the room and circulates it in the direction of the arrows of FIG. 1. It thus passes through the left hand one of tubes 26 into the plenum of heat exchanger 10 and out through the right hand one of tubes 26. The hot air is exhausted through register 48 and thus is circulated into the space to be heated.

Having thus described my invention in preferred embodiments, I claim:

1. Fireplace forced air heating apparatus, comprising:

(a) an upstanding, vertically and laterally elongated heat exchanger contoured and dimensioned for placement adjacent the rear wall of a fireplace and enclosing a plenum, (b) a pair of tubes connected to the heat exchanger adjacent the bottom and lateral sides thereof and communicating at their inner ends with the plenum, the tubes extending horizontally forward from the heat exchanger toward the front of the fireplace, (c) an elongated main duct disposed horizontally across and forwardly of the pair of tubes and extending laterally beyond said tubes, the ends of the main duct being open, (d) a pair of duct segments secured at their forward ends to the rear side and intermediate the ends of the main duct for communication therewith and extending rearwardly for communication of their rearward ends with the forward ends of the pair of tubes, (e) a pair of ports in the front side of the main duct substantially opposite the pair of duct segments, (f) a baffle member comprising a hollow plug receivable interchangeably in either of the pair of ports for communicating the associated duct segment with the adjacent open end of the main duct, whereby to deliver cool air from said open end to the heat exchanger for heating, the baffle member substantially closing the associated port and the main duct inwardly of said baffle member, (g) a fan assembly having an air inlet and an air outlet, the outlet being connectable interchangeably to either open end of the main duct for coupling said air outlet to the open end of the main duct adjacent the baffle member, for delivering cool air to the heat exchanger, and (h) a hot air outlet member comprising a hollow plug receivable interchangeably in either of the pair of ports for communicating the associated duct segment with the atmosphere through said plug and port, whereby to discharge hot air from the heat exchanger through the outlet member into the atmosphere.

2. The apparatus of claim 1 wherein the duct segments are of non-circular cross section, each of the pair of tubes includes inner and outer telescoping tubes of circular cross section, the outer end of the outer tube being of non-circular cross section matching and telescopically engaging the non-circular cross section of the duct segments, and a log stop is mounted on each of the outer telescoping tubes.

3. The apparatus of claim 1 wherein the heat exchanger has a front wall forming a log stop, and a log stop extends upwardly from each tube forwardly of the heat exchanger for confining between the stops and heat exchanger logs supported upon the tubes.

4. The apparatus of claim 3 wherein the duct segments are of non-circular cross section, each of the pair of tubes includes inner and outer telescoping tubes of circular cross section, the outer end of the outer tube being of non-circular cross section matching and telescopically engaging the non-circular cross section of the duct segments, and the log stops are mounted on the outer telescoping tubes.

5. The apparatus of claim 1 including a closure member connectable interchangeably to either open end of the main duct for closing the end thereof opposite the fan assembly.

* * * * *